US011111105B2

(12) United States Patent
Schmidt et al.

(10) Patent No.: US 11,111,105 B2
(45) Date of Patent: Sep. 7, 2021

(54) COMPLIANT SHEAR LAYER FOR ELEVATOR TERMINATION

(71) Applicant: Otis Elevator Company, Farmington, CT (US)

(72) Inventors: Walter Thomas Schmidt, Marlborough, CT (US); Joseph C. Rampone, Colchester, CT (US); Daniel A. Mosher, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 255 days.

(21) Appl. No.: 15/415,980

(22) Filed: Jan. 26, 2017

(65) Prior Publication Data

US 2018/0208436 A1 Jul. 26, 2018

(51) Int. Cl.

| | |
|---|---|
| ***B66B 7/08*** | (2006.01) |
| ***B66B 9/00*** | (2006.01) |
| ***B66B 7/06*** | (2006.01) |

(52) U.S. Cl.

CPC ..... *B66B 7/085* (2013.01); *B66B 7/062* (2013.01); *B66B 7/08* (2013.01); *B66B 9/00* (2013.01)

(58) Field of Classification Search

CPC ..... B66B 7/085; B66B 7/062; B66B 7/08; B66B 9/00

See application file for complete search history.

(56) References Cited

U.S. PATENT DOCUMENTS 3,822,442 A 7/1974 Herbschleb et al.
5,141,356 A * 8/1992 Chaize ..... E04C 5/122 254/29 A
5,503,257 A * 4/1996 Sugita ..... B66B 5/18 188/250 B
5,636,717 A * 6/1997 Cardenas ..... F16D 69/0416 188/250 D
5,979,615 A * 11/1999 Thompson ..... B66B 5/18 188/251 A
6,244,396 B1 * 6/2001 Lumpkin ..... B62L 1/10 188/24.11
6,256,841 B1 7/2001 Ericson et al.
6,357,085 B2 3/2002 Ericson et al.
6,371,261 B1 * 4/2002 Thompson ..... B66B 5/22 187/370
6,662,408 B2 12/2003 Perez et al.

(Continued)

FOREIGN PATENT DOCUMENTS

| | | |
|---|---|---|
| DE | 2457298 A1 | 6/1976 |
| EP | 3330210 A1 | 6/2018 |
| WO | 2012108872 A1 | 8/2012 |

OTHER PUBLICATIONS

DE 2457298—Machine Translation.*

Extended European Search Report Issued in EP Application No. 18153258.1, dated Jul. 30, 2018, 8 Pages.

*Primary Examiner* — Michael A Riegelman

(74) *Attorney, Agent, or Firm* — Cantor Colburn LLP

(57) ABSTRACT

A termination device for a suspension member of an elevator system includes a housing and a wedge assembly located in the housing. The wedge assembly includes a wedge interactive with the housing to apply a clamping force to the suspension member in response to an axial load acting on the suspension member and a compliant shear element secured to the wedge or the suspension member and configured to reduce shear loads on the suspension member.

13 Claims, 5 Drawing Sheets

(56) References Cited

U.S. PATENT DOCUMENTS 6,997,287 B2 * 2/2006 Sasaki ..... B66B 5/22 187/372
7,963,078 B1 * 6/2011 Sorkin ..... E04C 5/122 24/122.3
8,505,173 B2 8/2013 Pitts et al.
10,214,385 B2 * 2/2019 Eastman ..... B66B 5/22
2002/0154944 A1 10/2002 Traktovenko et al.
2007/0007405 A1 1/2007 Al-Mayah et al.
2007/0034454 A1 * 2/2007 Dold ..... B66B 7/062 187/411
2007/0240941 A1 * 10/2007 Fischer ..... B66B 5/18 187/359
2008/0279622 A1 * 11/2008 Al-Mayah ..... E04C 5/085 403/374.1
2008/0282512 A1 * 11/2008 Ach ..... B66B 7/085 24/136 R
2008/0296098 A1 * 12/2008 Sato ..... B66B 5/22 187/376
2011/0000746 A1 * 1/2011 Pelto-Huikko ..... B66B 7/062 187/254
2012/0141198 A1 6/2012 Kondo et al.
2014/0182975 A1 * 7/2014 Ikonen ..... B66B 5/0031 187/251
2014/0341646 A1 11/2014 Watanabe et al.
2015/0101889 A1 4/2015 Kere et al.
2015/0151948 A1 * 6/2015 Pelto-Huikko ..... B66B 9/00 187/254
2015/0307323 A1 * 10/2015 Zapf ..... B66B 7/062 187/411
2016/0185572 A1 * 6/2016 Lehtinen ..... F16G 11/044 187/411
2016/0207739 A1 * 7/2016 Pelto-Huikko ..... B66B 7/085
2016/0272466 A1 * 9/2016 Helenius ..... B66B 5/0031
2016/0355378 A1 * 12/2016 Lehtinen ..... B66B 7/085
2017/0036891 A1 * 2/2017 Lehtinen ..... B66B 7/085
2017/0189952 A1 * 7/2017 Lampinen ..... B21C 23/00
2017/0217730 A1 * 8/2017 Helenius ..... B66B 7/085
2018/0155156 A1 * 6/2018 Kuczek ..... B66B 9/00
2018/0162697 A1 * 6/2018 Schmidt ..... B66B 7/085
2018/0208434 A1 * 7/2018 Eastman ..... B66B 5/22

* cited by examiner

COMPLIANT SHEAR LAYER FOR ELEVATOR TERMINATION

BACKGROUND

The subject matter disclosed herein relates to elevator systems. More particularly, the present disclosure relates to termination of suspension members of elevator systems.

A typical elevator system includes an elevator car, suspended by one or more suspension members, typically a rope or belt, that moves along a hoistway. The suspension member includes one or more tension members and is routed over one or more sheaves, with one sheave, also known as a drive sheave, operably connected to a machine. The machine drives movement of the elevator car via interaction of the drive sheave with the suspension member. The elevator system further typically includes a counterweight interactive with the suspension member. One or more of the ends of the suspension member are terminated, or retained in the hoistway.

Elevator rope or belt terminations typically rely on the ability to either wrap the rope or belt around a wedge, or the ability to spread the individual wires of the rope and create a knob by placing the spread wires into a socket and potting with a material such as a babbitt or epoxy-based potting compound. These typical methods do not work for suspension members that utilize tension members formed from or including unidirectional fibers in a rigid matrix. In such an arrangement, the tension member will fracture if bent around a typical wedge radius, and the fibers are not able to be spread and bent to be utilized in the potted arrangement. Methods of terminating the suspension member which do not require such deformation occupy significant amounts of space and require a relatively high clamping force to retain the suspension member. Such methods are prone to under-tightening, resulting in slippage of the suspension member.

Thus, belts with such fiber tension members are typically terminated by capture of a substantially straight portion of the belt in a wedge-based termination. Such terminations utilize high clamping forces, which result in high shear stresses at the belt, in particular at an interface between the tension member and a enclosing the tension members. The high shear stresses may result in damage to the belt at the jacket/tension member interface.

BRIEF SUMMARY

In one embodiment, a termination device for a suspension member of an elevator system includes a housing and a wedge assembly located in the housing. The wedge assembly includes a wedge interactive with the housing to apply a clamping force to the suspension member in response to an axial load acting on the suspension member and a compliant shear element secured to the wedge or the suspension member and configured to reduce shear loads on the suspension member.

Additionally or alternatively, in this or other embodiments the compliant shear element is secured to a wedge inner surface and is configured to abut the suspension member.

Additionally or alternatively, in this or other embodiments the wedge assembly includes a wedge outer surface opposite the wedge inner surface, the wedge outer surface abutting a housing inner surface.

Additionally or alternatively, in this or other embodiments the compliant shear element is secured to one of the wedge or the suspension member via one or more of an adhesive, a mechanical fastener or a mechanically interlocking feature.

Additionally or alternatively, in this or other embodiments the compliant shear element has a stiffness in the range of 0.025 and 1.0 Giga Pascals.

Additionally or alternatively, in this or other embodiments the compliant shear element includes one or more friction-enhancing features to produce a desired frictional force between the compliant shear element and the suspension member.

In another embodiment, an elevator system includes a hoistway, an elevator car located in the hoistway, a suspension member operably connected to the elevator car to suspend and/or drive the elevator car along the hoistway, and a termination device located in the hoistway and operably connected to a suspension member end of the suspension member. The termination device includes a housing, and a wedge assembly located in the housing. The wedge assembly includes a wedge interactive with the housing to apply a clamping force to the suspension member in response to an axial load acting on the suspension member, and a compliant shear element secured to the wedge or the suspension member and configured to reduce shear loads on the suspension member.

Additionally or alternatively, in this or other embodiments the compliant shear element is secured to a wedge inner surface and abuts the suspension member.

Additionally or alternatively, in this or other embodiments the wedge assembly includes a wedge outer surface opposite the wedge inner surface, the wedge outer surface abutting a housing inner surface.

Additionally or alternatively, in this or other embodiments the compliant shear element is secured to the wedge via one or more of an adhesive, a mechanical fastener or a mechanically interlocking feature.

Additionally or alternatively, in this or other embodiments the compliant shear element has a stiffness in the range of 0.025 and 1.0 Giga Pascals.

Additionally or alternatively, in this or other embodiments the compliant shear element includes one or more friction-enhancing features to produce a desired frictional force between the compliant shear element and the suspension member.

Additionally or alternatively, in this or other embodiments the suspension member includes a plurality of tension elements extending along a length of the suspension member, each tension element including a plurality of fibers extending along the length of the suspension member bonded into a polymer matrix, and a jacket substantially retaining the plurality of tension members.

Additionally or alternatively, in this or other embodiments the plurality of fibers are formed from one or more of carbon, glass, polyester, nylon, or aramid material.

Additionally or alternatively, in this or other embodiments the compliant shear element is configured to reduce shear forces between the plurality of tension elements and the jacket.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
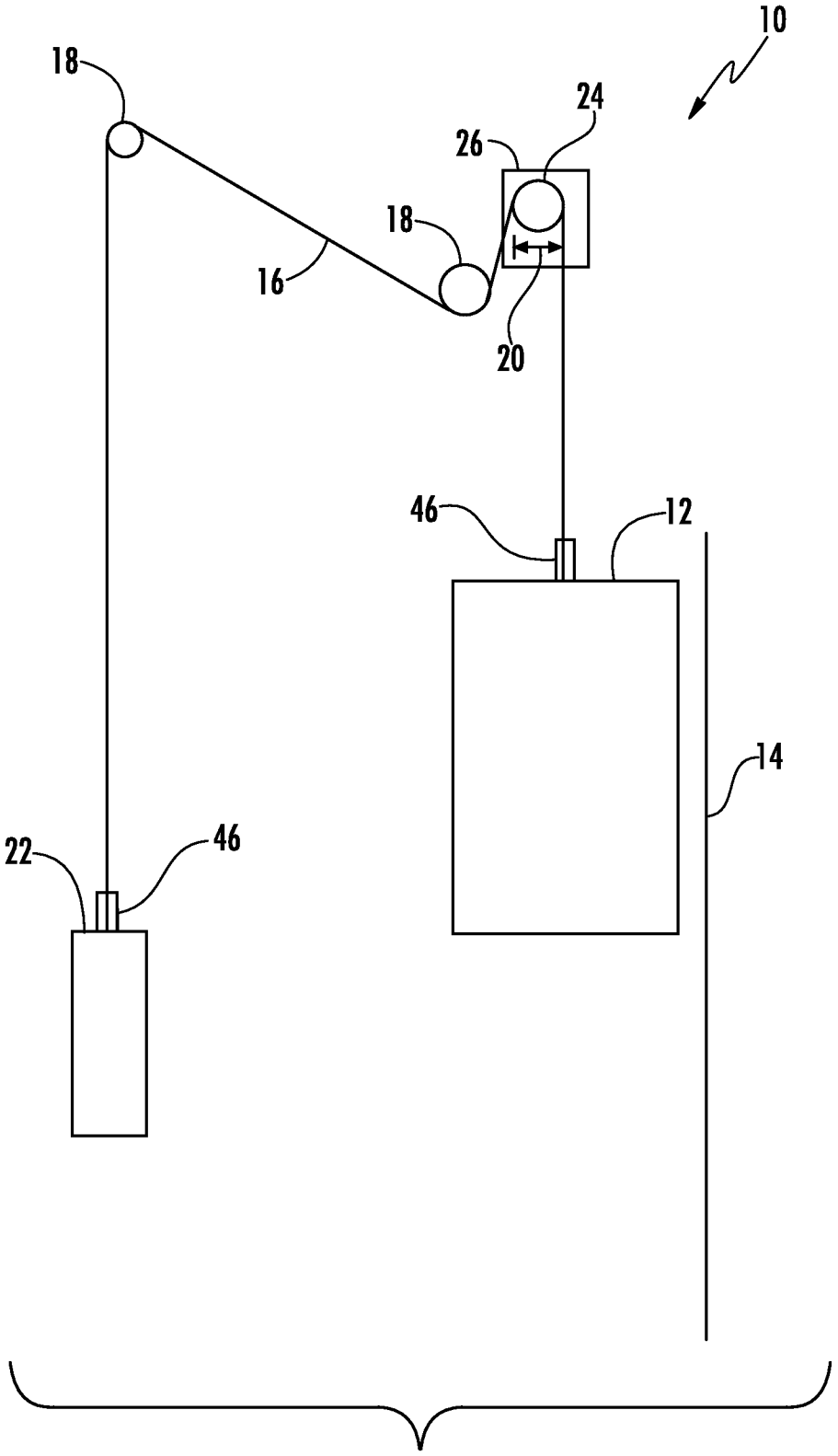
FIG. 1 is a schematic view of an exemplary elevator system.

Shown in FIG. 1, is a schematic view of an exemplary traction elevator system 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation.

The sheaves 18 each have a diameter 20, which may be the same or different than the diameters of the other sheaves 18 in the elevator system 10. At least one of the sheaves could be a traction sheave 24. The traction sheave 24 is driven by a machine 26. Movement of drive sheave by the machine 26 drives, moves and/or propels (through traction) the one or more belts 16 that are routed around the traction sheave 24. At least one of the sheaves 18 could be a diverter, deflector or idler sheave. Diverter, deflector or idler sheaves are not driven by a machine 26, but help guide the one or more belts 16 around the various components of the elevator system 10.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 or only one side of the one or more belts 16 engages the one or more sheaves 18. The embodiment of FIG. 1 shows a 1:1 roping arrangement in which the one or more belts 16 terminate at the car 12 and counterweight 22, while other embodiments may utilize other roping arrangements.

The belts 16 are constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12.

Figure 2:
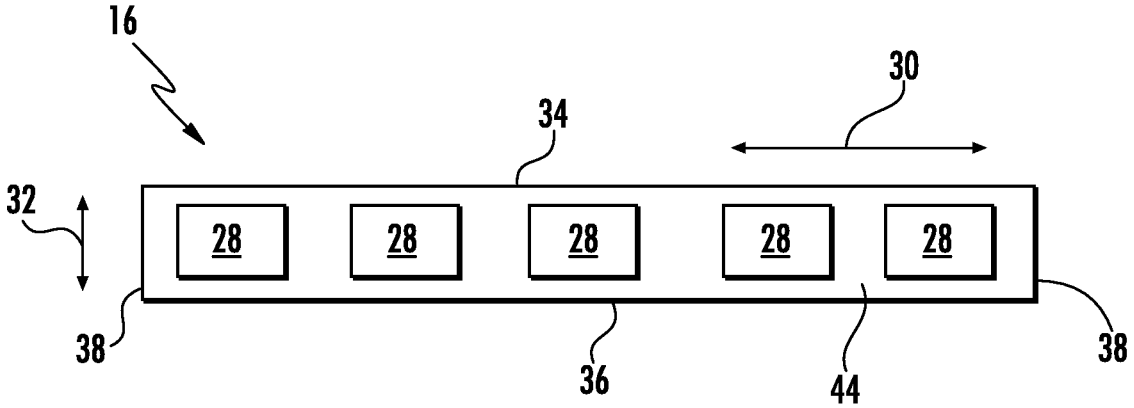
FIG. 2 is a cross-sectional view of an embodiment of a belt for an elevator system.

FIG. 2 provides a cross-sectional schematic of an exemplary belt 16 construction or design. The belt 16 includes a plurality of tension elements 28 extending longitudinally along the belt 16. While the tension elements 28 in the embodiment of FIG. 2 are rectangular in cross-section, it is to be appreciated that other cross-sectional shapes, such as circular, may be utilized in other embodiments. The tension elements 28 may be at least partially encased in a jacket 44, in some embodiments formed from a polymer material such as a thermoplastic polyurethane (TPU). The belt 16 has a belt width 30 and a belt thickness 32, with an aspect ratio of belt width 30 to belt thickness 32 greater than one. The belt 16 defines a traction side 34, which is interactive with the traction sheave 24 and a back side 36 opposite the traction side 34. The belt 16 further defines belt edges 38 extending between the traction side 34 and the back side 36.

Figure 3:
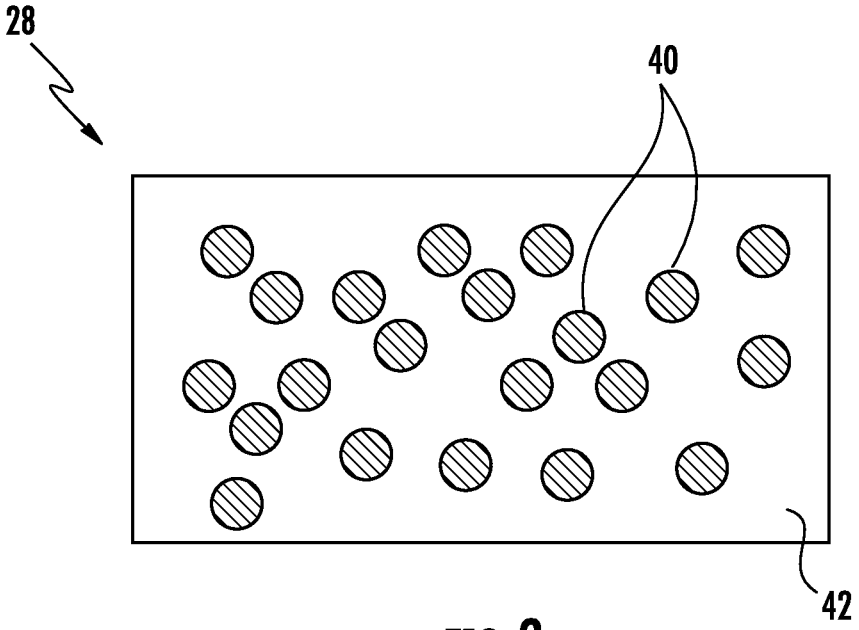
FIG. 3 illustrates an embodiment of a tension element for a belt of an elevator system.

Referring now to FIG. 3, the tension elements 28 include a plurality of fibers 40 bonded to a polymer matrix 42 to form the tension elements 28. The fibers 40 are continuous or discontinuous or combination of continuous and discontinuous over the belt 16 length and, oriented generally such that a fiber 40 length is directed along the belt 16 length. The fibers 40 may be formed of one or more of a number of materials, such as carbon, glass, polyester, nylon, aramid or other polyimide materials. Further, the fibers 40 may be organized into a grouping, such as a spun yarn. The matrix 42 may be formed of, for example a thermoset or thermoplastic material. The tension element 28 is further configured to have a fiber 40 density of 30% to 70% fibers 40 per unit of volume. In some embodiments, the fibers 40 may vary in size, length or circumference and may further be intentionally varied to provide a selected maximum fiber 40 density.

Figure 4:
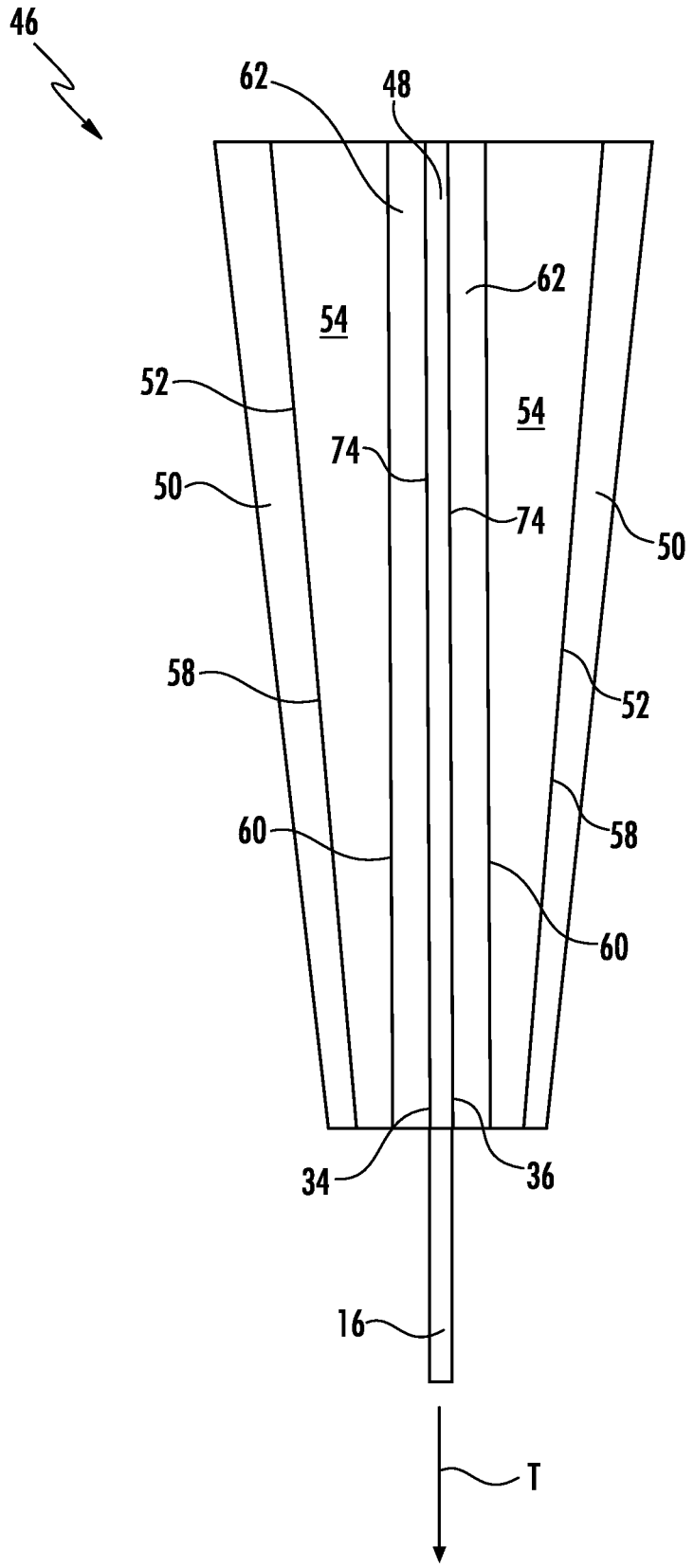
FIG. 4 illustrates a cross-sectional view of a termination for a belt of an elevator system.

Referring now to FIG. 4, an embodiment of a termination 46 is illustrated. A belt end 48 of the belt 16 is installed and retained in the termination 46 at, for example, the elevator car 12 or the counterweight 22, as shown in FIG. 1. The termination 46 includes a housing 50, with a housing inner surface 52 tapering inwardly toward the belt 16 with increasing distance from the belt end 48. A wedge 54 is installed in the housing 50 between the housing inner surface 52 and the belt 16. In some terminations 46, two wedges 54 are disposed in the housing 50, while in other embodiments a single wedge 54 is utilized. A first wedge 54 is installed between the housing inner surface 52 and the traction surface 34 of the belt 16, with the first wedge 54 interactive with the traction surface 34. Additionally, a second wedge 54 is installed between the housing inner surface 52 and the back surface 36 of the belt 16 and is interactive with the back surface 36. Edge wedge 54 includes a wedge outer surface 58 abutting the housing inner surface 52 and having a taper complimentary with the housing inner surface 52. The wedge 54 further includes a wedge inner surface 60 opposite the wedge outer surface 58.

A shear element 62 is located between the wedge inner surface 60 and the belt 16. The shear element 62 is configured to relax the shear loading on the belt 16, particularly at the interface between the tension elements 28 and the jacket 44, reducing shear levels at this interface to prevent damage to or failure of the interface. The shear element 62 is a compliant element, and is formed from, for example, a thermoplastic urethane (TPU), rubber or elastomeric material. In some embodiments, a stiffness of the shear element 62 is between about 0.025 and 1.0 Giga Pascals.

Figure 5:
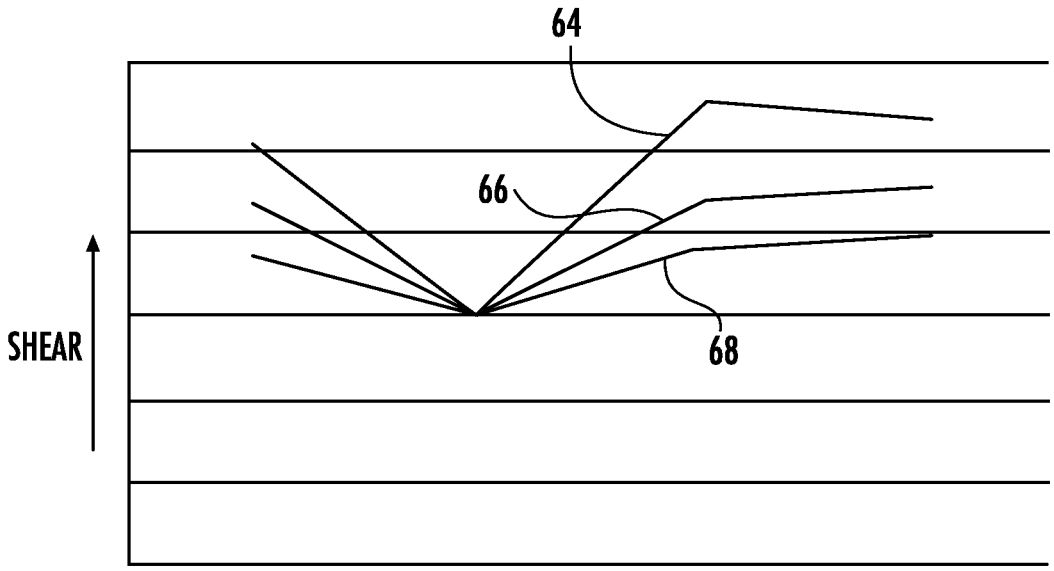
FIG. 5 schematic graphical representation of shear stress reduction in some embodiments of a termination.

As shown in the graph of FIG. 5, the dynamic shear stress is greatly reduced using the shear element 62 of a compliant material. Line 64 represents dynamic shear stress in a configuration without a shear element, with the steel wedge 54 abutting the belt 16. Line 66 represents use of a shear element 62 with a stiffness of 1.0 GPa, and line 68 represents use of a shear element 62 with a stiffness of about 0.1 GPa.

Figure 6:
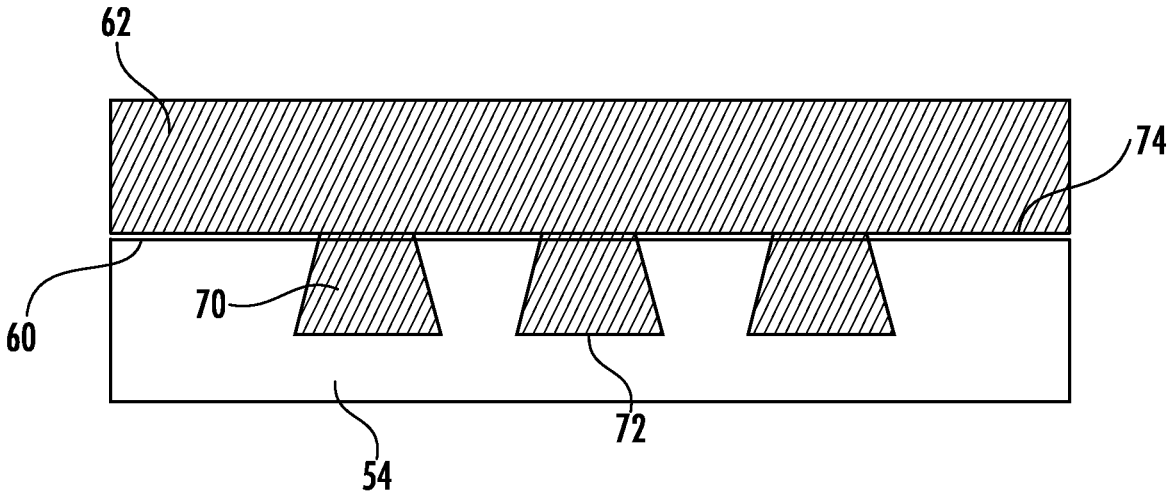
FIG. 6 is a cross-sectional view of an embodiment of a shear element attachment to a termination wedge.

Referring again to FIG. 4, in some embodiments the shear element 62 is secured to the wedge inner surface 60. The shear element 62 may be secured to the wedge inner surface 60 by, for example, adhesives, mechanical fasteners, or mechanically interlocking features on the wedge inner surface 60 and the shear element 62. These may include, for example as shown in FIG. 6, one or more tabs 70 on the shear element 62 engagable with one or more slots 72 on the wedge inner surface 60. One skilled in the art will readily appreciate that such an arrangement may be reversed such that the one or more tabs 70 are located at the wedge inner surface 60 and the one or more slots 72 are located at the shear element 62. It is to be appreciated that the size, shape and orientation of features shown in FIG. 6 are merely exemplary and that other configurations may be utilized to retain the shear element 62 at the wedge inner surface 60. Further, the shear element 62 may be adhered to the belt 16 while being installed in the hoistway 14 through similar means.

Figure 7:
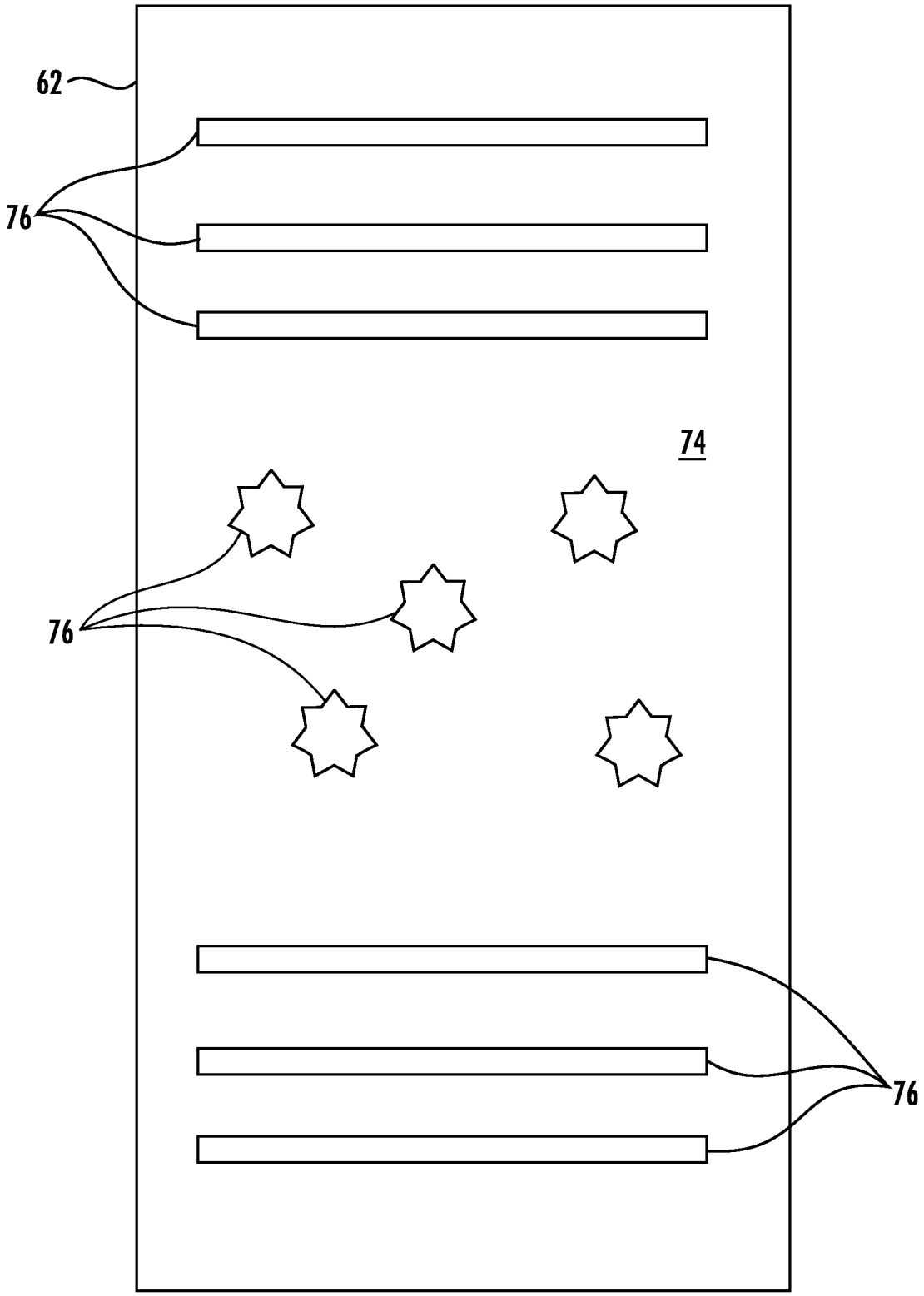
FIG. 7 is a plan view illustrating embodiments of friction enhancing features.

Referring now to FIG. 7, a shear element inner surface 74, which interfaces with the jacket 44, includes one or more friction-enhancing features 76 to achieve a desired friction between the shear element 62 and the belt 16. The friction-enhancing features 76 may be formed as one or more of grooves, ridges or faceted elements as shown in FIG. 7. It is to be appreciated that the friction-enhancing features 76 shown are merely exemplary, and other forms of friction-enhancing features 76 are contemplated within the present scope.

The shear element 62 reduces shear forces at the jacket 44 and tension element 28 interface, thus reducing risk of damage and/or failure of the interface and reducing the risk of tension element 28 slippage at the termination 46.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A termination device for a suspension member of an elevator system comprising:

a housing; and a two wedge assemblies disposed in the housing and located at opposing sides of the suspension member, each wedge assembly including:

a wedge interactive with the housing to apply a clamping force to the suspension member in response to an axial load acting on the suspension member; and a compliant shear element secured to the wedge or the suspension member and configured to reduce shear loads on the suspension member;

wherein the compliant shear element is secured to the wedge via two or more tabs disposed at one of the compliant shear element or a wedge inner surface of the wedge, the two or more tabs engageable with two or more slots in the other of the wedge inner surface or the compliant shear element;

wherein the compliant shear element is formed from one of a thermoplastic urethane or elastomeric material;

wherein the compliant shear element includes a plurality of friction-enhancing features to produce a desired frictional force between the compliant shear element and the suspension member, the plurality of friction-enhancing features including a plurality of faceted elements arrayed across a lateral width of the compliant shear element.

2. The termination device of claim 1, wherein the compliant shear element is secured to the wedge inner surface and is configured to abut the suspension member.

3. The termination device of claim 2, wherein the wedge assembly includes a wedge outer surface opposite the wedge inner surface, the wedge outer surface abutting a housing inner surface.

4. The termination device of claim 1, wherein the compliant shear element is secured to one of the wedge or the suspension member via one or more of an adhesive, a mechanical fastener or a mechanically interlocking feature.

5. The termination device of claim 1, wherein the compliant shear element has a stiffness in the range of 0.025 and 1.0 Giga Pascals.

6. An elevator system comprising:

a hoistway;

an elevator car disposed in the hoistway;

a suspension member operably connected to the elevator car to suspend and/or drive the elevator car along the hoistway; and a termination device disposed in the hoistway and operably connected to a suspension member end of the suspension member, the termination device including:

a housing; and a two wedge assemblies disposed in the housing and located at opposing sides of the suspension member, each wedge assembly including:

a wedge interactive with the housing to apply a clamping force to the suspension member in response to an axial load acting on the suspension member; and a compliant shear element secured to the wedge or the suspension member and configured to reduce shear loads on the suspension member;

wherein the compliant shear element is secured to the wedge via two or more tabs disposed at one of the compliant shear element or a wedge inner surface of the wedge, the two or more tabs engageable with two or more slots in the other of the wedge inner surface or the compliant shear element;

wherein the compliant shear element is formed from one of a thermoplastic urethane or elastomeric material;

wherein the compliant shear element includes a plurality of friction-enhancing features to produce a desired frictional force between the compliant shear element and the suspension member, the plurality of friction-enhancing features including a plurality of faceted elements arrayed across a lateral width of the compliant shear element.

7. The termination device of claim 6, wherein the compliant shear element is secured to the wedge inner surface and abuts the suspension member.

8. The termination device of claim 7, wherein the wedge assembly includes a wedge outer surface opposite the wedge inner surface, the wedge outer surface abutting a housing inner surface.

9. The termination device of claim 6, wherein the compliant shear element is secured to the wedge via one or more of an adhesive, a mechanical fastener or a mechanically interlocking feature.

10. The termination device of claim 6, wherein the compliant shear element has a stiffness in the range of 0.025 and 1.0 Giga Pascals.

11. The elevator system of claim 6, wherein the suspension member includes:

a plurality of tension elements extending along a length of the suspension member, each tension element including a plurality of fibers extending along the length of the suspension member bonded into a polymer matrix; and a jacket substantially retaining the plurality of tension members.

12. The elevator system of claim 11, wherein the plurality of fibers are formed from one or more of carbon, glass, polyester, nylon, or aramid material.

13. The elevator system of claim 11, wherein the compliant shear element is configured to reduce shear forces between the plurality of tension elements and the jacket.

* * * * *